US008776803B2

(12) United States Patent
Tarora et al.

(10) Patent No.: US 8,776,803 B2
(45) Date of Patent: Jul. 15, 2014

(54) FILTER HOLDER USED FOR SMOKING, A SMOKING PIPE, AND A SMOKING PIPE UNIT

(75) Inventors: Masafumi Tarora, Tokyo (JP); Michihiro Inagaki, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 1022 days.

(21) Appl. No.: 11/898,786

(22) Filed: Sep. 14, 2007

(65) Prior Publication Data

US 2008/0053465 A1 Mar. 6, 2008

Related U.S. Application Data

(63) Continuation of application No. PCT/JP2006/304132, filed on Mar. 3, 2006.

(30) Foreign Application Priority Data

Mar. 17, 2005 (JP) ..... 2005-077095

(51) Int. Cl.
*A24F 7/04* (2006.01)
*A24F 1/00* (2006.01)

(52) U.S. Cl.
USPC ..... 131/187; 131/202

(58) Field of Classification Search
USPC ..... 131/187
See application file for complete search history.

(56) References Cited

U.S. PATENT DOCUMENTS

| | | | | |
|---|---|---|---|---|
| 2,833,289 | A | 5/1958 | Atkins | |
| 3,603,319 | A * | 9/1971 | Badgett et al. | 131/274 |
| 3,926,199 | A | 12/1975 | Thomas | |
| 4,254,782 | A | 3/1981 | Ligeti | |
| 4,343,320 | A | 8/1982 | Muto | |
| 4,865,056 | A * | 9/1989 | Tamaoki et al. | 131/337 |
| 5,724,997 | A | 3/1998 | Smith et al. | |
| 6,631,722 | B2 * | 10/2003 | Warren et al. | 131/331 |

FOREIGN PATENT DOCUMENTS

| | | | |
|---|---|---|---|
| EP | 0 109 608 | A1 | 5/1984 |
| GB | 1 239 164 | A | 7/1971 |
| JP | 49-66785 | U | 6/1974 |
| JP | 51-65988 | U | 5/1976 |
| JP | 56-15683 | A | 2/1981 |
| JP | 57-43793 | U | 3/1982 |
| JP | 58-41832 | B2 | 9/1983 |
| JP | 60-234577 | A | 11/1985 |
| JP | 01-098471 | A | 4/1989 |
| JP | 3-9672 | Y2 | 3/1991 |
| JP | 62-17893 | U | 8/1994 |
| JP | 7-79759 | A | 3/1995 |
| JP | 07079759 | * | 3/1995 |
| JP | 11-346748 | A | 12/1999 |
| RU | 2024403 | C1 | 12/1994 |

* cited by examiner

*Primary Examiner* — Philip Tucker
*Assistant Examiner* — Vicki Wu
(74) *Attorney, Agent, or Firm* — Birch, Stewart, Kolasch & Birch, LLP

(57) ABSTRACT

A filter holder used for smoking has a tubular body (12), which includes a socket portion (14) for receiving a cigarette (C) at one end thereof, a dilution chamber (18) located adjacently to the socket portion (14) in the inside, a chamber (22) for containing a charcoal filter (26), a chamber (24) for containing a flavor generation element (32), an annular groove (42) formed in the outer circumferential surface of the body (12), and a plurality of vent holes (44) formed in the bottom of the annular groove (42) and introduces outside air into the dilution chamber (18).

15 Claims, 16 Drawing Sheets

FILTER HOLDER USED FOR SMOKING, A SMOKING PIPE, AND A SMOKING PIPE UNIT

This application is a Continuation of copending PCT International Application No. PCT/JP2006/304132 filed on Mar. 3, 2006, which designated the United States, and on which priority is claimed under 35 U.S.C. §120. This application also claims priority under 35 U.S.C. §119(a) on Patent Application No(s). 2005-077095 filed in Japan on Mar. 17, 2005. The entire contents of each of the above documents is hereby incorporated by reference.

TECHNICAL FIELD

The present invention relates to a filter holder used for smoking, a smoking pipe and a smoking pipe unit including the filter holder, respectively.

BACKGROUND ART

A smoking pipe attachable to one end of a cigarette as a rod-shaped smoking article is disclosed, for example, in Unexamined Japanese Utility Model Publication No. 51-65988 (Document 1). The smoking pipe of Document 1 includes a socket portion formed in one end of the pipe and is capable of receiving one end of a cigarette, a mouthpiece formed in the other end, and a filter contained in the filter holder. The filter is positioned in between the socket portion and the mouthpiece.

Before the cigarette is smoked, the smoking pipe is attached to one end of a cigarette. A smoker then lights the other end of the cigarette and puts the mouthpiece of the smoking pipe in his/her mouth. By so doing, the smoker can smoke the cigarette. At this point, the mainstream smoke of the cigarette passes through the filter in the smoking pipe and is sent from the mouthpiece into the smoker's mouth. Therefore, a part of particle-phase components, such as tar and nicotine in the mainstream smoke is trapped by the filter. Therefore, the smoker can enjoy a mild smoking feeling.

However, the filter of the smoking pipe of Document 1 is not capable of reducing vapor-phase components (acetaldehyde, acetone, benzene, etc.) and gas-phase components (CO, NO, etc.) which are contained in the mainstream smoke. As a result, the vapor-phase components and the gas-phase components are not removed with the filter and sent into the smoker's mouth.

In this respect, a filter cigarette disclosed in Unexamined Japanese Patent Publication No. 11-346748 (Document 2) has a perforation line formed in a tip paper of the cigarette. A smoking pipe disclosed in Unexamined Japanese Patent Publication No. 56-15683 (Document 3) includes a perforation line formed in an outer circumferential wall of the pipe. During smoking, the perforation line allows the outside air to flow into the filter, and the introduced air dilutes mainstream smoke. This dilution of the mainstream smoke reduces not only the particle-phase components such as tar and nicotine, which are actually sent into the smoker's mouth, but also the vapor-phase and gas-phase components.

In the case of the dilution-type filter cigarette and smoking pipe, when a dilution rate of the mainstream smoke is excessively high, a tar amount in the mainstream smoke which is sent into the smoker's mouth, that is, a nicotine amount in the tar, is undesirably reduced. As a result, the smoker cannot enjoy the original flavor and taste of the cigarette. In this point, Document 2 discloses that a reduction rate of the tar (T) is suppressed, as compared to a reduction rate of CO, by locating the perforation line upstream from the filter as viewed in the flowing direction of the mainstream smoke. It can be considered that, according to the filter cigarette of Document 2, a value of C/T (=CO/T) is reduced, so that a desired tar amount to be sent into the smoker's mouth can be secured. In this respect, in the case of the smoking pipe of Document 3, too, the perforations are positioned upstream from the filter. Therefore, the smoking pipe of Document 3 may have the same advantages as the filter cigarette of Document 2.

In the case of the filter cigarette of Document 2, in order to position the perforation line upstream from the filter, the perforation line has to be located in the end portion of the tip paper on the cigarette side. The end portion of the tip paper, however, is an important element for joining the filter and the cigarette together, so that the end portion of the tip paper needs to be firmly bonded to the cigarette. That is to say, it is required that glue be applied to the entire inner surface of the end portion of the tip paper. When the perforation line is located in the end portion of the tip paper regardless of this requirement, glue is applied onto the inner surface of the end portion except for the perforation line, and it is impossible to secure an adequate glue-applied area. As a result, bond strength between the filter and the cigarette is low, and it is then practically difficult to form the perforation line in the end portion of the tip paper.

In this respect, according to Document 3, the perforation line is formed in the smoking pipe itself. Therefore, the smoking pipe of the Document 3 does not have the above problem seen in the filter cigarette of Document 2. However, according to Documents 2 and 3, there is the possibility that the perforation line would be partially blocked by smoker's fingers during smoking. When the perforation line is blocked even partially, air intake into the filter becomes insufficient, and mainstream smoke is not diluted as desired.

It is preferable that the above-mentioned smoking pipe be capable not only of performing a conventional basic treatment for removing tar from the mainstream smoke and diluting the vapor-phase and gas-phase components but also of carrying out an adding treatment for adding flavor such as menthol to the mainstream smoke during smoking.

DISCLOSURE OF THE INVENTION

It is an object of the present invention to provide a filter holder for smoking which is capable of reliably exerting the above-mentioned conventional basic function or an additional function with respect to mainstream smoke during smoking, a smoking pipe and a smoking pipe unit including the filter holder, respectively.

In order to achieve the above object, a filter holder of the present invention comprises a tubular body including a holder portion formed in one end portion thereof and capable of holding smokable material and a chamber defined in the tubular body adjacently to the holder portion and capable of containing a filter for filtering mainstream smoke of the smokable material, and a mixing device for mixing a gaseous fluid to be used for processing the mainstream smoke with the mainstream smoke at least in either one of an upstream area including an upstream end of the chamber and a downstream area of the chamber as viewed in a flowing direction of the mainstream smoke.

Before the filter holder is used, the filter is contained in the chamber of the filter holder, and a rod-shaped smoking article such as a cigarette is held by the holder portion of the filter holder. In this state, the smoker can light the rod-shaped smoking article and draw the mainstream smoke of the rod-shaped smoking article from the other end of the filter holder. When the mainstream smoke passes through the filter, a part of particle-phase components, such as tar and nicotine, contained in the mainstream smoke is trapped by the filter.

The mixing device mixes the mainstream smoke and the gaseous fluid in the filter holder during smoking. This fluid carries out a dilution process and/or a flavor-adding process with respect to the mainstream smoke.

More specifically, the mixing device may include a recessed area formed in an outer circumferential surface of the tubular body and is not blocked by a smoker's fingers when the tubular body is held by the fingers, and a vent hole in which one end is open in the recessed area, and the other end is open in an inner circumferential surface of the tubular body in the upstream area. Preferably, the recessed area is an annular groove formed in the outer circumferential surface of the tubular body, and the vent hole is formed in a bottom of the annular groove.

During smoking, outside air is introduced into the tubular body through the vent hole. The air thus introduced dilutes the mainstream smoke. Since the vent hole is formed in the recessed area, namely the bottom of the annular groove, even if the smoker holds the filter holder by pinching the holder with the fingers, the vent hole is not blocked by the fingers. Therefore, the dilution process with respect to the mainstream smoke can be surely carried out during smoking.

Since the vent hole is not formed in the rod-shaped smoking article such as a cigarette but formed in the tubular body, it is possible to secure adequate opening of the vent hole and then to enhance a dilution rate of the mainstream smoke without difficulty.

In the case of a conventional filter cigarette, when the dilution rate of the mainstream smoke is increased, CO concentration in the mainstream smoke is reduced. At the same time, the particle-phase components, such as tar and nicotine, are also reduced, so that it is impossible to effectively reduce a value of C/T.

However, the filter used in the filter holder of the invention has smaller ventilation resistance than a filter for a conventional filter cigarette, which reduces a filtration rate of the particle-phase components, such as tar and nicotine, through the filter. As a result, the value of C/T is effectively reduced.

When a filter having small resistance to draw is used in the conventional filter cigarette, the entire filter cigarette's resistance to draw is also lowered at the same time. The smoker then feels very unpleasant during smoking.

In this respect, the filter holder of the invention comprises the mixing device, namely the vent hole, which is located in the upstream area of the chamber in which the filter is contained. For this reason, reduction of the drawing resistance of the filter itself is compensated, and the filter holder of the invention is capable of maintaining the drawing resistance similar to that of the conventional filter cigarette.

Consequently, according to the filter holder of the invention, the C/T can be reduced without undesirably reducing the particle-phase components, such as tar and nicotine. Furthermore, the drawing resistance during smoking is secured as in the conventional filter cigarette. Therefore, the smoker can fully enjoy original flavor and taste of the smoking article.

The mixing device may further include a dilution chamber located in between the holder portion and the chamber in the tubular body. The dilution chamber is connected to the vent hole. The mainstream smoke is well mixed with outside air in the dilution chamber to be evenly diluted.

The mixing device may further include an adjust ring for adjusting the opening of the vent hole. The adjust ring is disposed within the annular groove and is movable in either one of a circumferential direction or axial direction of the tubular body. The adjust ring easily adjusts the dilution rate of the mainstream smoke, that is, air ventilation of the filter holder.

Preferably, when the smokable material is a rod-shaped smoking article such as a cigarette, the holder portion of the tubular body is formed as a cylindrical socket for receiving an end portion of the rod-shaped smoking article.

The mixing device may include a downstream chamber which is located downstream of the chamber in the tubular body and contains a flavor generation element for generating flavor to be added to the mainstream smoke. In this case, when the filter holder of the invention is used in a state where the filter and the flavor generation element are contained in the tubular body, a flavor component generated from the flavor generation element is mixed with the mainstream smoke that has passed through the filter. Therefore, the smoker can enjoy the flavor of the flavor generation element in addition to the original fragrant and taste of the mainstream smoke.

To be concrete, the tubular body may include a main portion having an upstream chamber and a secondary portion having a downstream chamber. The main and secondary portions are detachably coupled to each other.

The invention provides a smoking pipe including the filter holder. To be more specifically, the smoking pipe of the invention has a filter holder including a tubular body, the filter holder having a holder portion formed in one end portion of the tubular body and capable of holding smokable material, and a chamber defined in the tubular body adjacently to the holder portion and capable of containing a filter for filtering mainstream smoke of the smokable material, a mouthpiece provided to the other end portion of the tubular body, and a mixing device for mixing a gaseous fluid to be used for processing the mainstream smoke with the mainstream smoke at least in either one of an upstream area including an upstream end of the chamber and a downstream area of the chamber as viewed in a flowing direction of the mainstream smoke.

The mixing device of the smoking pipe may include the means for introducing diluted air and/or a downstream chamber for containing a flavor generation element in the downstream of the chamber.

The invention provides a smoking pipe unit including the filter holder. More specifically, the smoking pipe unit of the invention has a filter holder including a tubular body, the filter holder having a holder portion formed in one end portion of the tubular body and capable of holding smokable material, an upstream chamber defined in the tubular body adjacently to the holder portion, and a downstream chamber secured downstream of the upstream chamber in the tubular body, a mixing device for mixing a gaseous fluid to be used for processing mainstream smoke with the mainstream smoke at least in either one of an upstream area including an upstream end of the upstream chamber and the downstream chamber as viewed in a flowing direction of the mainstream smoke, a filter pack obtained by airtightly packing a filter for filtrating the mainstream smoke of the smokable material when contained in the upstream chamber, and an element pack obtained by airtightly packing a flavor generation element for generating flavor to be added to the mainstream smoke when contained in the downstream chamber.

The present invention further provides a smoking pipe in which the filter and the flavor generation element are previously installed. To be concrete, the smoking pipe of the invention has a filter holder including a tubular body, the filter holder having a holder portion formed in one end portion of the tubular body and capable of holding smokable material, an upstream chamber defined in the tubular body adjacently to the holder portion, and a downstream chamber secured downstream of the upstream chamber, an absorption filter contained in the upstream chamber, for filtrating mainstream smoke of the smokable material, a flavor generation element contained in the downstream chamber, for generating flavor to be added to the mainstream smoke, and a separator for airtightly separating the flavor generation element from the filter before the smoking pipe is used, the separator allowing air communication between the filter and the flavor generation element before the smoking pipe is used. Specifically, the filter is a charcoal filter, and the flavor generation element volatilizes menthol.

The separator reliably prevents the flavor component generated from the flavor generation element from being absorbed by the absorption filter after the smoking pipe is used. Therefore, original absorption performance of the absorption filter is not deteriorated.

BEST MODE OF CARRYING OUT THE INVENTION

Figure 1:
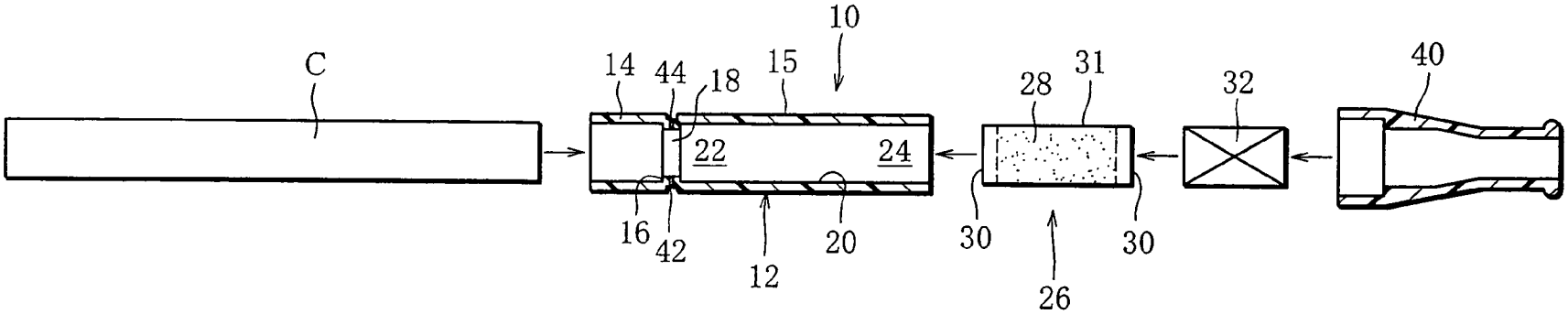
FIG. 1 is a sectional view showing a smoking pipe using a filter holder of a first embodiment, taken apart into parts.

A smoking pipe of a first embodiment which is shown in FIG. 1 comprises a filter holder 10. The filter holder 10 includes a hollow cylinder, namely a tubular body 12, which is made of synthetic resin. The tubular body 12 has an open end in each end thereof.

One end portion and the other end portion of the tubular body 12 are formed as a socket portion 14 and a loading portion 15, respectively. The socket portion 14 and the loading portion 15 are separated from each other by an annular partition 16 located in the tubular body 12. The annular partition 16 is protruding from an inner circumferential surface of the tubular body 12. Accordingly, the partition 16 has a smaller internal diameter than the socket portion 14. The socket portion 14 has an internal diameter that is slightly larger than an external diameter of a rod-shaped smoking article C. Therefore, the rod-shaped smoking article C is insertable into the socket portion 14 until contacting the annular partition 16. The rod-shaped smoking article C includes a cigarette, a filter cigarette, a cigarillo, a cigar or the like, each of which has cut surfaces at both ends.

The annular partition 16 has given thickness along an axial direction of the tubular body 12. The inside of the annular partition 16 is defined as a dilution chamber 18. The dilution chamber 18 connects the inside of the socket portion 14 and the inside of the loading portion 15 to each other. The inside of the loading portion 15 is defined as a treatment chamber 20 for treating mainstream smoke. More specifically, a part of the treatment chamber 20 which is located on the side of the dilution chamber 18 of the chamber 20 is used as a filter-containing chamber 22, whereas the rest part of the treatment chamber 20 which is located on the side of the other end portion of the tubular body 12 is used as a flavor-containing chamber 24.

A path running from the dilution chamber 18 through the filter-containing chamber 22 to the flavor-containing chamber 24 forms a treatment channel for carrying out the basic process and the adding process with respect to the mainstream smoke of the rod-shaped smoking article. The entire treatment chamber 20 may be used as the filter-containing chamber 22

The filter-containing chamber 22 is capable of receiving, for example, a filter 26. The filter 26 is removably inserted from an opening located at the other end of the tubular body 12 into the filter-containing chamber 22 through the flavor-containing chamber 24.

According to the present embodiment, the filter 26 is, for example, a charcoal filter, and has lower ventilation resistance than a filter provided to a conventional filter cigarette. The charcoal filter 26 includes a main filter portion 28 disposed in the center of the charcoal filter 26, secondary filter portions 30 located in respective ends of the main filter portion 28, and forming paper 31 wrapping the filter portions 28 and 30 to join the filter portions 28 and 30 together. The main filter portion 28 has filter material formed of a bundle of cellulose acetate fibers, active-charcoal particles distributed in the filter material, and wrapping paper wrapping the filter material into a cylindrical shape. The secondary filter portion 30 has filter material similar to the filter material of the main filter portion 28 and wrapping paper wrapping the filter material into a cylindrical shape.

Since the charcoal filter 26 has the secondary filter portions 30 in the respective ends of the main filter portion 28, the active-charcoal particles in the main filter portion 28 do no fall out of the charcoal filter 26. The charcoal filter 26 may include only the main filter portion 28.

The flavor-containing chamber 24 is capable of receiving the cylindrical flavor generation element 32 so as to be detachable. The flavor generation element 32 has filter material, for example, similar to the filter material, flavoring such as menthol added into the filter material, and wrapping paper wrapping the filter material into a cylindrical shape. The flavor generation element 32 may include filter portions at respective ends thereof, which are similar to the secondary filter portions 30 of the charcoal filter 26.

Figure 2:
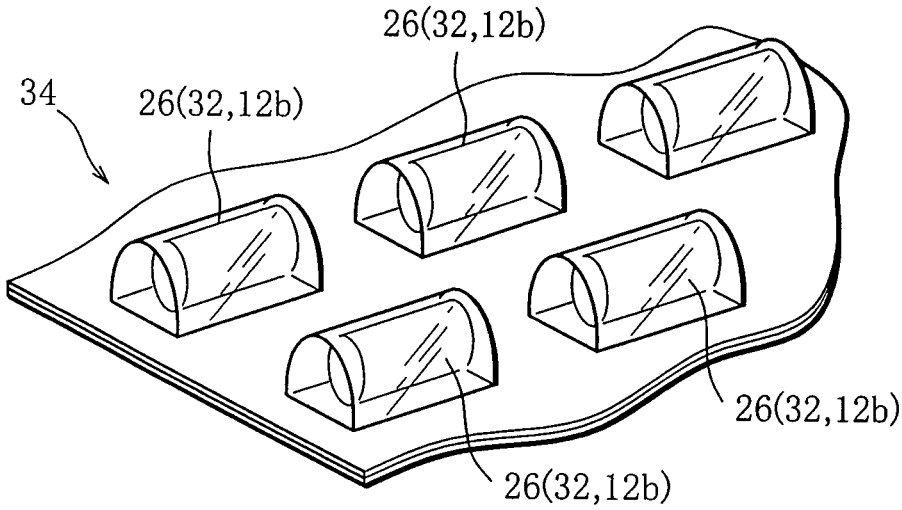
FIG. 2 is a perspective view showing a blister pack for a charcoal filter or a flavor generation element used in the smoking pipe of FIG. 1.
Figure 3:
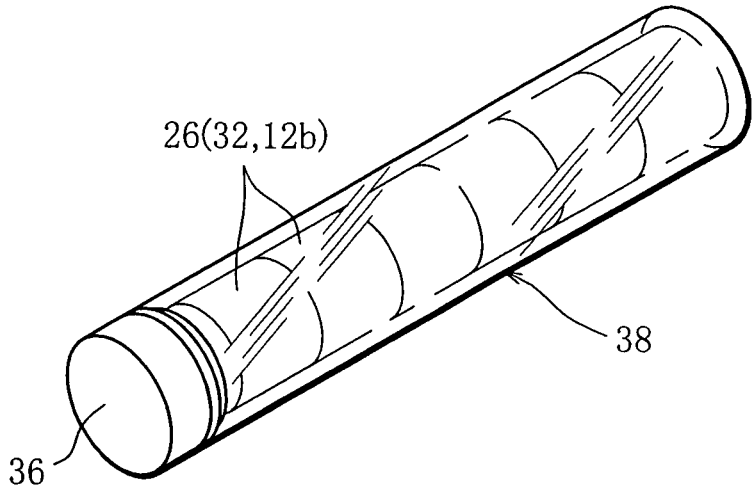
FIG. 3 is a perspective view showing an airtight container as an alternative to the blister pack of FIG. 2.

Preferably, the charcoal filter 26 and the flavor generation element 32 are airtightly packed before being contained in the containing chambers 22 and 24 of the tubular body 12. For example, a blister pack 34 capable of packing charcoal filters 26 or flavor generation elements 32 individually as illustrated in FIG. 2 and a tubular airtight container 38 capable of containing a group of given number of the charcoal filters 26 or the flavor generation elements 32 as illustrated in FIG. 3 are suitable for the packing of the charcoal filters 26 or the flavor generation elements 32. The airtight container 38 has an openable/closable cap 36.

The blister pack 34 and the airtight container 38 are a part of a smoking pipe unit together with the filter holder 10.

The smoking pipe of the present embodiment further includes a mouthpiece 40, which is made of synthetic resin. The mouthpiece 40 is detachably connected to the other end of the tubular body 12.

Figure 4:
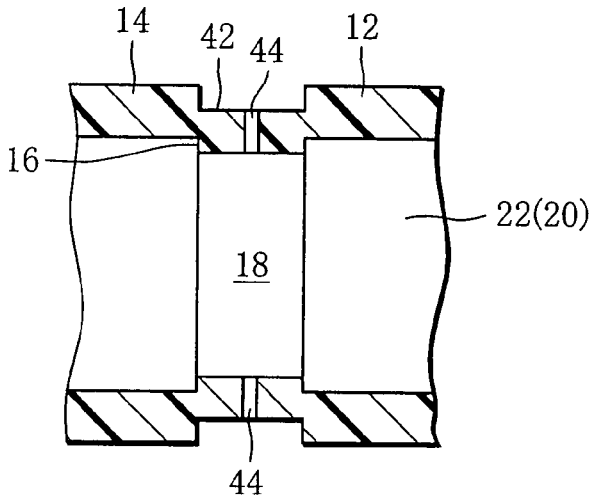
FIG. 4 is an enlarged view showing a part of the filter holder of FIG. 1.
Figure 5:
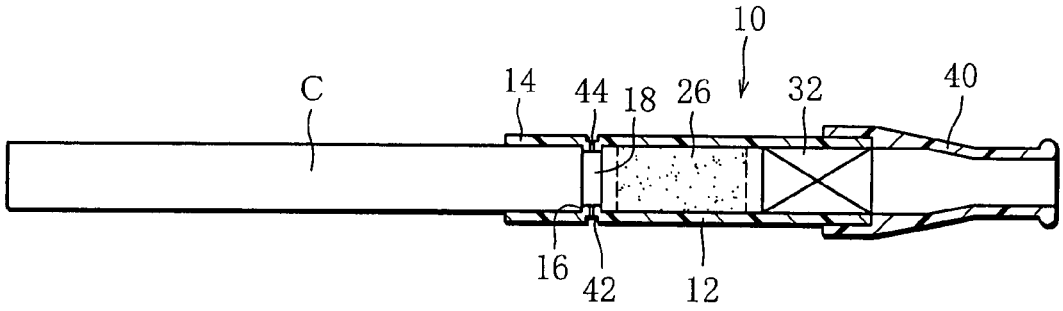
FIG. 5 is a sectional view of the smoking pipe of FIG. 1 in an assembled state.

As illustrated in FIG. 4, the tubular body 12 has an annular groove 42 in an outer circumferential surface thereof. The annular groove 42 extends through the entire circumference of the tubular body 12 and is so arranged as to surround the dilution chamber 18. The annular groove 42 has width that is adequately narrower than width of a smoker's finger. This prevents the finger from entering the annular groove 42.

There is a plurality of vent holes 44 in the annular groove 42. Each of the vent holes 44 has one end that opens into a bottom of the annular groove 42 and the other end communicating with the dilution chamber 18. The vent holes 44 are distributed at given intervals in a circumferential direction of the annular groove 42. The annular groove 42 and the vent holes 44 form an air inlet for introducing outside air into the dilution chamber 18.

The smoking pipe is assembled in a manner described below.

First, the charcoal filter 26 and the flavor generation element 32 are inserted in order from the other end of the tubular body 12 into the filter holder 10, namely the containing chamber 20 of the tubular body 12. The charcoal filter 26 and the flavor generation element 32 are arranged in the filter-containing chamber 22 and the flavor-containing chamber 24, respectively. The mouthpiece 40 is subsequently fitted to the other end of the tubular body 12.

After the assembly of the smoking pipe is thus completed, for example, a cigarette C as a rod-shaped smoking article is inserted into the socket portion 14 of the filter holder 10, and the cigarette C and the smoking pipe are coupled to each other. In this state, the smoker puts the mouthpiece 40 of the smoking pipe in his/her mouth and lights a tip end of the cigarette C. By so doing, the smoker can smoke the cigarette C.

The mainstream smoke of the cigarette C which is drawn by the smoker during smoking first flows into the dilution chamber 18. The drawing of the mainstream smoke introduces the outside air into the dilution chamber 18 through the vent holes 44 of the annular chamber 42. The air thus introduced dilutes the mainstream smoke in the dilution chamber 18. The diluted mainstream smoke is sent into the smoker's mouth through the charcoal filter 26 and the flavor generation element 32. Such dilution of the mainstream smoke reduces an amount of particle-phase components, such as tar and nicotine, contained in the mainstream smoke that is actually sent into the smoker's mouth and an amount of vapor-phase components and gas-phase components contained in the mainstream smoke.

Since the vent holes 44 are formed in the bottom of the annular groove 42, the vent holes 44 are not blocked by the smoker's fingers during smoking. The vent holes 44 and the annular groove 44 reliably introduce the outside air into the dilution chamber 18, which enhances a dilution rate of the mainstream smoke.

The diluted mainstream smoke passes through the charcoal filer 26. In this process, the filter material of the charcoal filter 26 catches a part of the particle-phase components, such as tar and nicotine, from the mainstream smoke, and the active-charcoal particles contained in the filter material partially absorb the vapor-phase components contained in the mainstream smoke. Therefore, the vapor components in the mainstream smoke are drastically reduced by the above-mentioned diluting and absorbing processes.

When the dilution rate of the mainstream smoke is high, and the ventilation resistance of the charcoal filter 26 is low, CO concentration in the mainstream smoke drawn by the smoker can be reduced without undesirably reducing the particle-phase components, such as tar and nicotine. As a result, the C/T is decreased to a large extent.

Since the dilution chamber 18 is located immediately upstream of the charcoal filter 26 as viewed in a flowing direction of the mainstream smoke, and the dilution rate of the mainstream smoke is high, the cigarette holder 10 can provide the smoker with the same resistance to draw as a conventional filter cigarette by the diluted mainstream smoke passing through the charcoal filter 26.

As described above, even if the C/T is reduced, the particle-phase components, such as nicotine and tar, and the resistance to draw are not undesirably reduced. Therefore, the smoker does not feel unpleasant during smoking and fully enjoy original flavor and taste of the cigarette C.

The mainstream smoke then flows from the charcoal filter 26 into the flavor generation element 32 and passes through the flavor generation element 32. At this point, the mainstream smoke is added with flavor component volatized from the flavoring of the flavor generation element 32. The flavor component and the mainstream smoke are delivered together into the smoker's mouth through the mouthpiece 40. Consequently, the smoker can enjoy the flavor of the flavoring in addition to the fragrant and taste of the cigarette C.

When the smoking pipe is assembled as described above, the flavor generation element 32 is placed adjacently to the charcoal filter 26 in the filter holder 10 for the first time. Before the smoking pipe is assembled, that is, before the cigarette C is smoked, the active-charcoal particles in the charcoal filter 26 are not poisoned by the flavor component volatized from the flavoring of the flavor generation element 32. As a result, the charcoal filter 26 fully carries out the original function thereof.

Figure 6:
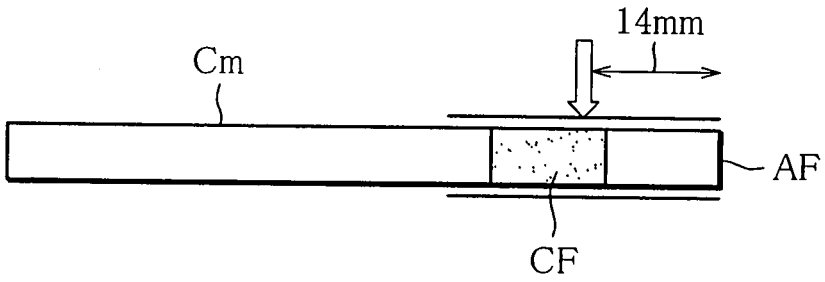
FIG. 6 is a schematic view showing a filter cigarette of a first comparative example.
Figure 7:
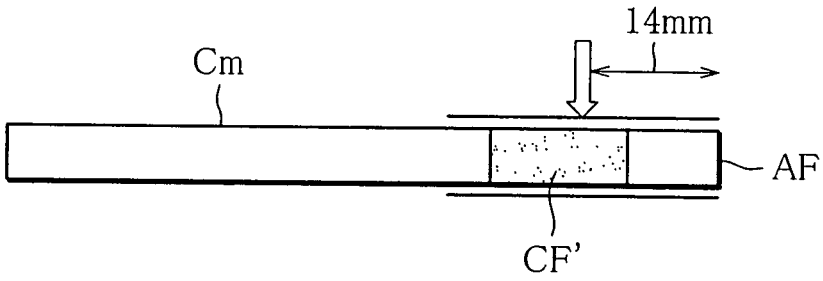
FIG. 7 is a schematic view showing a filter cigarette of a second comparative example.
Figure 8:
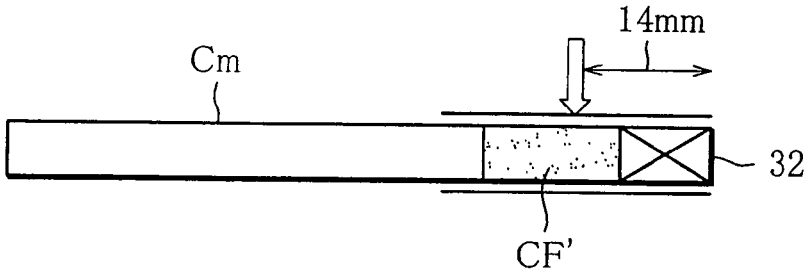
FIG. 8 is a schematic view showing a filter cigarette of a third comparative example.

In order to verify advantages of the smoking pipe of the first embodiment, filter cigarettes of first to third comparative examples as illustrated in FIGS. 6 to 8 are prepared.

A filter cigarette of FIG. 6 (first comparative example) is MILD SEVEN Super Light (brand name) that is commercially available. The filter cigarette includes a cigarette Cm and a dual filter with a perforation line. The dual filter has a charcoal filter portion CF and a plane filter portion AF. The charcoal filter portion CF corresponds to the main filter portion 28 (see FIG. 1). The plane filter portion AF is similar to the secondary filter portion 30.

A filter cigarette of FIG. 7 (second comparative example) includes a cigarette Cm and a dual filter similar to that of the filter cigarette of the first comparative example. However, the dual filter of the second comparative example has a larger amount of active-charcoal particles contained in a charcoal filter CF' than that contained in the charcoal filter CF of the first comparative example.

A filter cigarette of FIG. 8 (third comparative example) includes a cigarette Cm and a dual filter. This dual filter has a charcoal filter CF' similar to the charcoal filter of the second comparative example and a flavor generation element 32 similar to the above-mentioned flavor generation element.

TABLE 1 shows specifications of the filter cigarettes of the first to third comparative examples and specifications of the verification object.

TABLE 1

| | 1st Example | 2nd Example | 3rd Example | Verification Object |
|---|---|---|---|---|
| Vf (%) | 45 | 45 | 45 | 58 |
| D (mm) | 14 | 14 | 14 | 30 |
| Lf (mm) | 25 | 27 | 27 | 30 |
| Rf ($mmH_2O$) | 90 | 90 | 90 | 50 |
| Rw ($mmH_2O$) | 100 | 100 | 100 | 100 |
| Qc (mg) | 30 | 140 | 140 | 140 |
| Qm (mg) | — | — | 2.84 | 2.84 |

In TABLE 1, Vf, D, Lf, Rf, Rw, Qc and Qm represent as follows:

Vf: Air ventilation rate of the filter

D: Distance between the end on a mouthpiece-side of the filter and the perforation line Lf: Substantial length of the filter Rf: Filter's resistance to draw Rw: Entire filter cigarette's resistance to draw Qc: Adding quantity of active-charcoal particles Qma: Adding quantity of menthol A smoking test is conducted with respect to the first and third comparative examples and the verification object. The test measures quantities of smoke components, vapor-phase components and menthol contained in the mainstream smoke (mainstream smoke delivered into a smoker's mouth) that is released from the mouthpiece-side end of the smoking pipe of each of the filter cigarettes of the comparative examples and the verification object. The measurement result is shown in TABLE 2 below.

Regarding C/T and the delivering quantity of the vapor-phase component, TABLE 2 shows a reduction rate ΔCT of C/T and a reduction rate ΔV of the delivering quantity in the second and third embodiments and the verification object, using the first comparative example as a reference (0.00), respectively.

TABLE 2

| | | 1st Example | 2nd Example | 3rd Example | Verification Object |
|---|---|---|---|---|---|
| Smoke components | Tar(mg) | 6.40 | 6.47 | [—] | 6.51 |
| | Nicotine(mg) | 0.58 | 0.56 | [—] | 0.64 |
| | CO(mg) | 9.17 | 9.12 | [—] | 6.29 |
| | C/T | 1.43 | 1.41 | [—] | 0.97 |
| Vapor-phase components | ΔCT | 0.00 | [—] | [—] | 0.33 |
| | Acetaldehyde (GC area) | 2.14 | 0.17 | [—] | 0.10 |
| | Acetone(GC area) | 1.26 | 0.03 | [—] | 0.06 |
| | Benzene(GC area) | 0.31 | 0.01 | [—] | 0.01 |
| | Total amount (GC area) | 9.79 | 0.45 | [—] | 0.40 |
| ΔV | Acetaldehyde | 0.00 | 0.92 | 0.74 | 0.95 |
| | Acetone | 0.00 | 0.98 | 0.78 | 0.95 |
| | Benzene | 0.00 | 0.97 | 0.77 | 0.96 |
| | Total amount | 0.00 | 0.95 | 0.76 | 0.96 |
| Menthol delivering qantity Qmd(mg) | | 0 | 0 | 0.015 | 0.68 |

Figure 9:
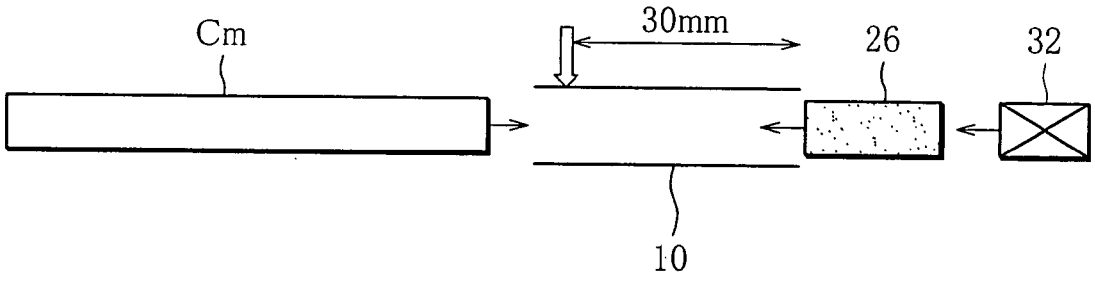
FIG. 9 is a schematic view showing a filter holder as an object of verification according to the present invention.

FIG. 9 schematically shows a smoking pipe as a verification object, from which the mouthpiece 40 is removed. The smoking pipe is applied to a cigarette Cm similar to the cigarettes Cm of the first to third comparative examples.

In TABLE 2, values of the vapor-phase components are detected by gas chromatography.

Figure 10:
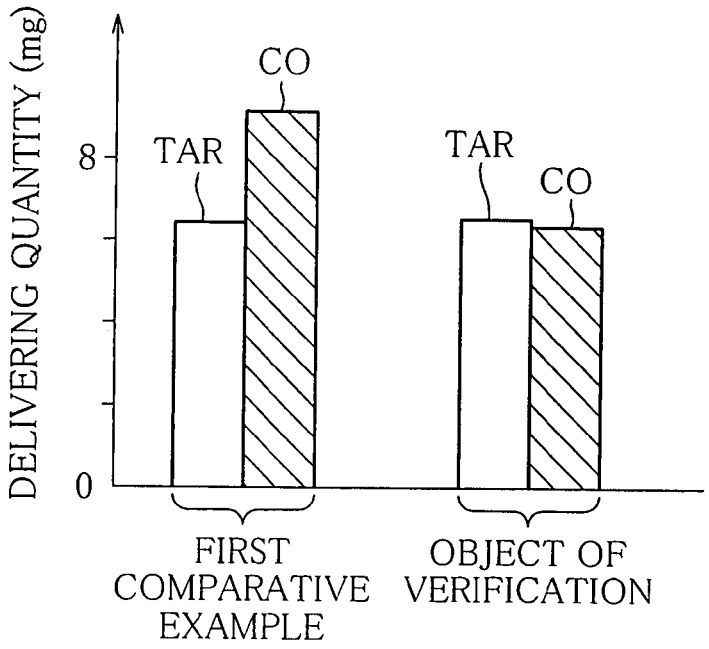
FIG. 10 is a graph showing a result of comparison between the first comparative example and the verification object in terms of tar and CO.
Figure 11:
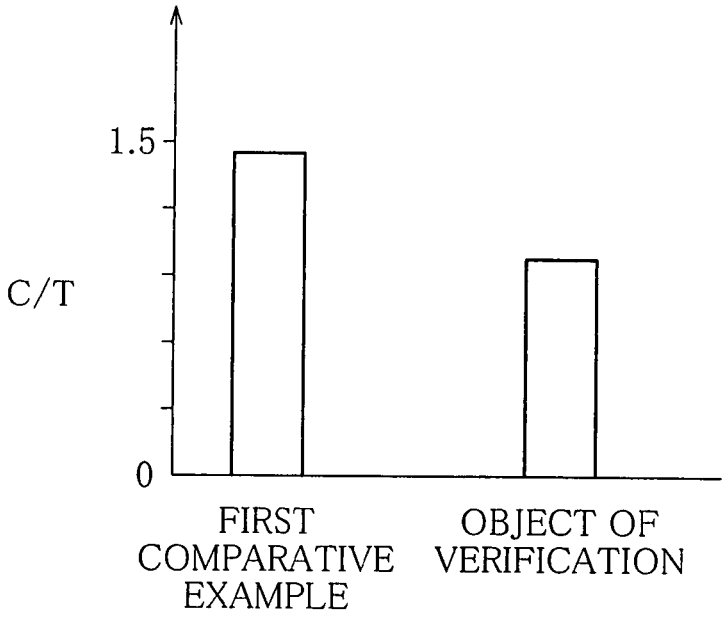
FIG. 11 is a graph showing a result of comparison between the first comparative example and the verification object in terms of C/T.
Figure 12:
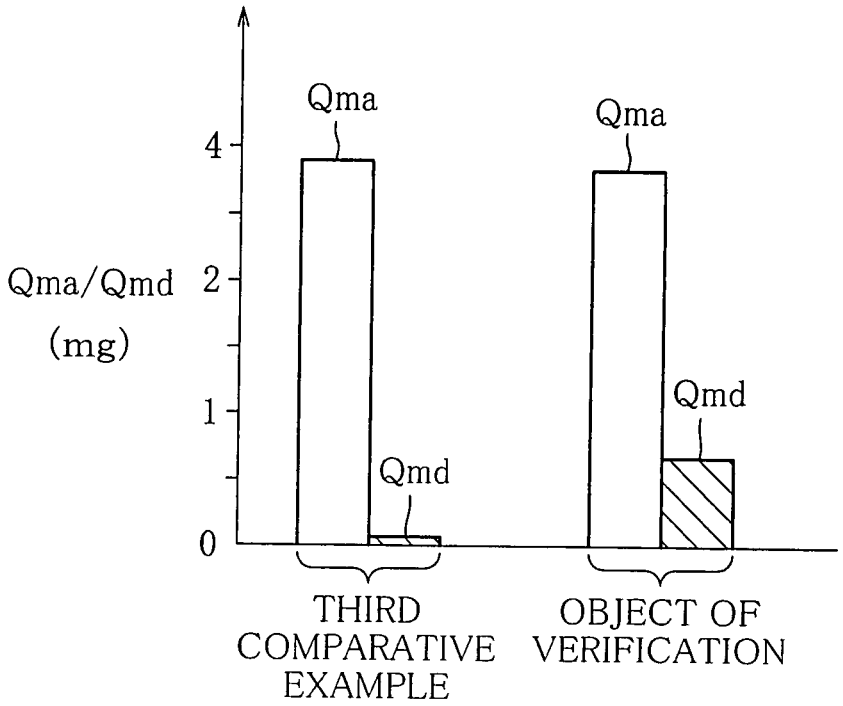
FIG. 12 is a graph showing a result of comparison between the third comparative example and the verification object in terms of a menthol delivering amount.

Graphs of FIGS. 10 to 12 can be made on the basis of TABLE 2. FIG. 10 shows a result of comparison between the first comparative example and the verification object in respect of delivering quantities of tar and CO. As is obvious from FIG. 10, there is little difference between the first comparative example and the verification object in terms of the tar delivering quantity. However, the CO delivering quantity of the verification object is reduced more greatly than that of the first comparative example. This is because the mainstream smoke from the cigarette Cm is highly diluted in the case of the smoking pipe of the verification object, as compared to the filter cigarette of the first comparative example.

As illustrated in FIG. 11, the C/T of the verification object is greatly improved, as compared to that of the first comparative example. The results shown in FIGS. 10 and 11 are attributable to the fact that the smoking pipe, or filter holder 10, of the verification object has the above-described structure.

FIG. 12 shows a result of comparison between the third comparative example and the verification object in respect of the menthol delivering quantity Qmd. As is apparent from FIG. 12, there is no difference between the third comparative example and the verification object in the menthol adding quantity Qma. However, the delivering quantity Qmd in the verification object is greatly increased, as compared to the delivering quantity Qmd in the third comparative example. This is attributed to the fact that, differently from the third comparative example, the flavor generation element 32 is removed from the blister pack or the airtight container immediately before the smoking test and is contained in the filter holder 10. That is to say, in the case of the smoking pipe of the verification object, the charcoal filter 26 and the flavor generation element 32 are located adjacently to each other immediately before the smoking test, so that the menthol of the flavor generation element 32 stored in the blister pack or the airtight container is not absorbed by the active charcoal of the charcoal filter 26. For this reason, the smoking pipe of the verification object can deliver a large amount of menthol.

In the case of the filter cigarette of the third comparative example, the charcoal filter CF' and the flavor generation element 32 are located adjacently to each other immediately after the filter cigarette is produced. Therefore, the menthol of the flavor generation element 32 is absorbed by the active charcoal of the charcoal filter CF' before the smoking test, so that the menthol delivering quantity from the filter cigarette becomes almost zero by the time of the smoking test.

The present invention is not limited to the first embodiment and may be modified in various ways.

The filter holder 10 of the first embodiment may have a plurality of longitudinal grooves instead of the annular groove 42. The longitudinal grooves extend in an axial direction of the filter holder 10 and are spaced out in a circumferential direction of the filter holder 10. Each of the longitudinal grooves has smaller width than the smoker's finger. There are formed vent holes in bottoms of the longitudinal grooves. The vent holes communicate with the dilution chamber 18. Such vent holes are also not blocked by the smoker's fingers during smoking, so that outside air can be introduced into the dilution chamber 18 without fail.

The filter holder 10 of the first embodiment is capable of containing an absorption filter including a particulate absorption agent other than the active-charcoal particles, and a plane filter, instead of the charcoal filter 26.

In the filter holder 10 of the first embodiment, the charcoal filter 26 may be previously accommodated in the filter-containing chamber 22. In this case, the flavor generation element 32 is accommodated in the flavor-containing chamber 24 of the filter holder 10, before smoking. The smoking pipe of the first embodiment does not necessarily require the mouthpiece 40.

Figure 13:
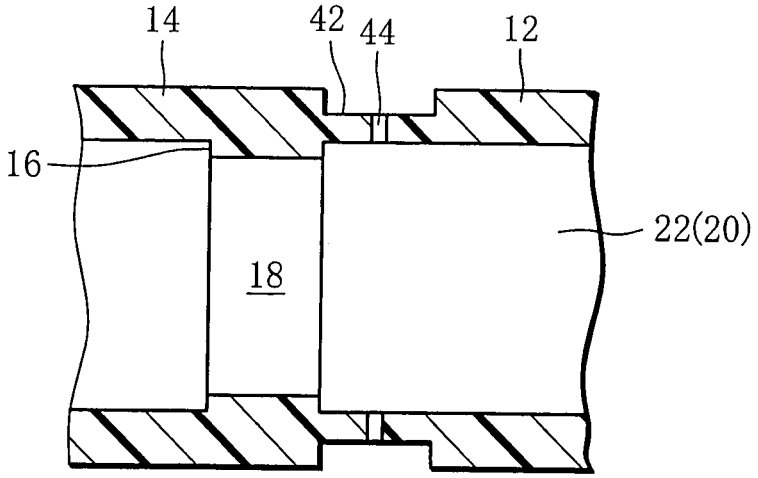
FIG. 13 is a sectional view showing a part of a filter holder according to a second embodiment of the present invention.

FIG. 13 shows the filter holder 10 of a second embodiment.

The filter holder 10 of FIG. 13 has an annular groove 42 that is so arranged as to surround the upstream end of a filter-containing chamber 22. A plurality of vent holes 44 are formed in a bottom of the annular groove 42. In this case, outside air is introduced from the vent holes 44 through the wrapping paper into an upstream end of a charcoal filter 26 and dilutes the mainstream smoke from the cigarette during smoking.

Figure 14:
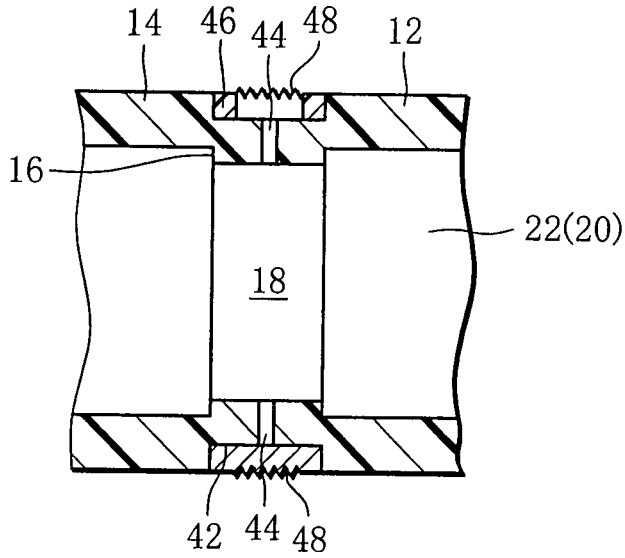
FIG. 14 is a sectional view showing a part of a filter holder according to a third embodiment of the present invention.

FIG. 14 shows a part of a filter holder of a third embodiment.

The filter holder 10 of the third embodiment further includes an adjust ring 46. The adjust ring 46 is made of synthetic resin and embedded in the annular groove 42 of the tubular body 12. The adjust ring 46 rotates in the circumferential direction of the tubular body 12 and has a plurality of slots 48 corresponding to the vent holes 44 of the annular groove 42. The slots 48 extend in a circumferential direction of the adjust ring 46, and have such length that the slots 48 are not completely blocked by the smoker's fingers during smoking. By carrying out a rotating operation, the adjust ring 46 is capable of fully opening/closing the vent holes 44 or of adjusting the opening of the vent holes 44. An upper half of FIG. 14 shows a state in which the vent hole 44 is opened through the slot 48 of the adjust ring 46, whereas a lower half of FIG. 14 shows a state in which the vent hole 44 is closed by the adjust ring 46.

Figure 15:
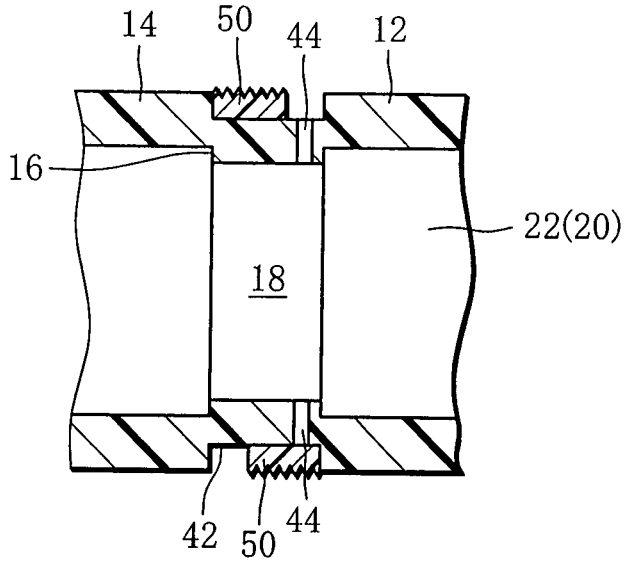
FIG. 15 is a sectional view showing a part of a filter holder according to a fourth embodiment of the present invention.

FIG. 15 shows a part of a filter holder 10 of a forth embodiment.

The filter holder 10 of the forth embodiment further includes an adjust ring 50 different from the adjust ring 46. The adjust ring 50 is also made of synthetic resin and embedded in the annular groove 44. The adjust ring 50 is slidable in the axial direction of the tubular body 12. The sliding operation of the adjust ring 50 allows the opening/closing of vent holes 44 or the opening adjustment of the vent holes 44. An upper half of FIG. 15 shows a state in which the vent hole 44 is opened by the adjust ring 50, whereas a lower half of FIG. 15 shows a state in which the vent hole 44 is closed by the adjust ring 50.

The adjust rings 46 and 50 are capable of adjusting the amount of air introduced into the dilution chamber 18 during smoking, thereby varying air ventilation rate of the filter holder 10 without difficulty.

Figure 16:
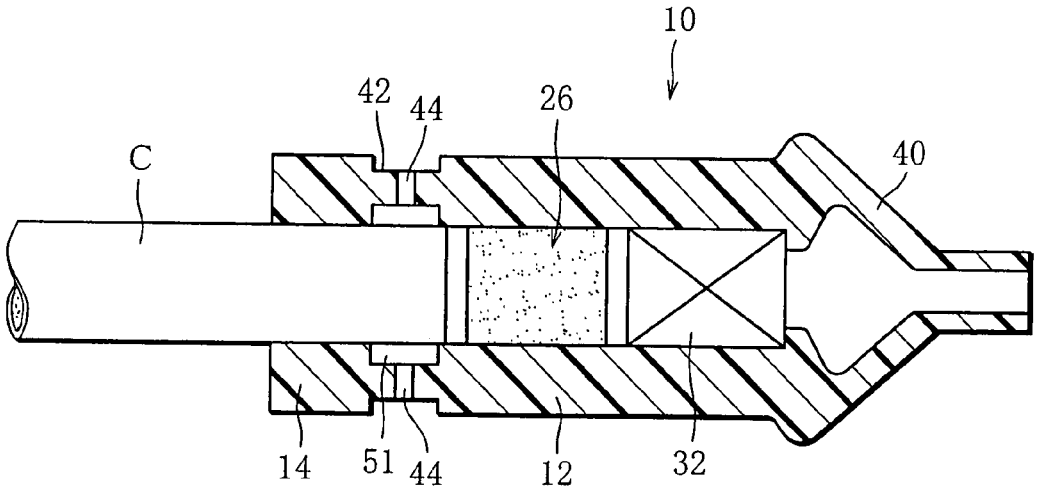
FIG. 16 is a sectional view showing a smoking pipe including a filter holder according to a fifth embodiment of the present invention.

FIG. 16 shows a filter holder 10 of a fifth embodiment.

The filter holder 10 of the fifth embodiment includes a tubular body 12 integrally formed with a mouthpiece 40. In this case, a flavor generation element 32 and a charcoal filter 26 are accommodated in the tubular body 12 in order from the socket portion 14 side as with the cigarette C.

As is clear from FIG. 16, the filter holder 10 of the fifth embodiment does not have a dilution chamber 18 in between the cigarette C and the filter-containing chamber 22, and has an annular chamber 51 instead of the dilution chamber 18. The annular chamber 51 is formed in an inner circumferential surface of the socket portion 14. An annular groove 42 with vent holes 44 is formed in an outer circumferential surface of the socket portion 14. When the cigarette C is inserted into the socket portion 14, the annular chamber 51 can surround an end portion of the cigarette C. In this case, the outside air introduced through the vent holes 44 flows into the annular chamber 51 and then flows out of the annular chamber 51 into the end portion of the cigarette C through the wrapping paper of the cigarette C, to thereby dilute the mainstream smoke.

Figure 17:
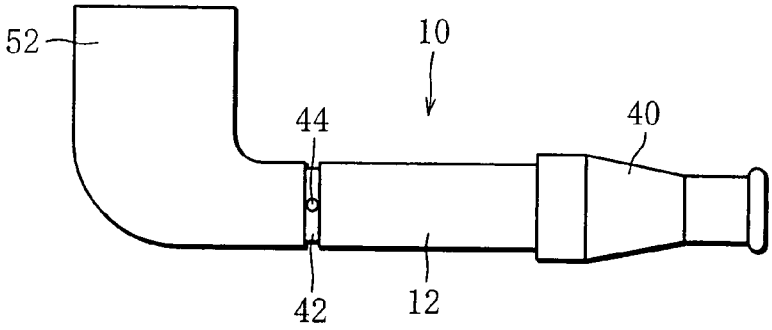
FIG. 17 is a side view showing a smoking pipe including a filter holder according to a sixth embodiment of the present invention.

FIG. 17 shows a filter holder 10 of a sixth embodiment.

The filter holder 10 of the sixth embodiment has a bowl 52 instead of the socket portion 14. Shred tobacco as smoking material is stuffed into the bowl 52. The stuffed shred tobacco is lighted to produce mainstream smoke. The mainstream smoke is transferred through the mouthpiece 40 into the smoker's mouth. The filter holder 10 is made completely of wood, or alternatively at least the bowl 52 is made of synthetic resin with heat resistance.

Figure 18:
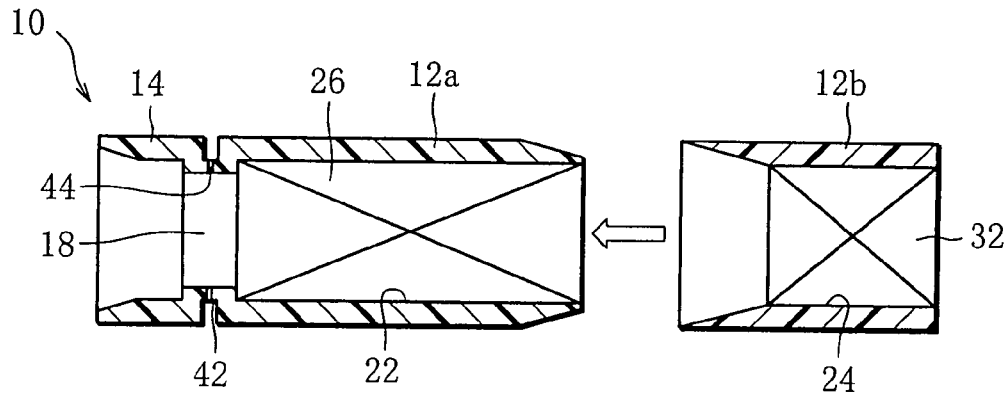
FIG. 18 is an exploded sectional view showing a filter holder according to a seventh embodiment of the present invention.

FIG. 18 shows a filter holder 10 of a seventh embodiment.

The filter holder 10 of the seventh embodiment is provided with a split-type tubular body. The tubular body includes a main portion 12*a* and a secondary portion 12*b*. The main portion 12*a* has the socket portion 14 and the filter-containing chamber 22, whereas the secondary portion 12*b* has the flavor-containing chamber 24. The secondary portion 12*b* is detachably coupled to a downstream end of the main portion 12*a* from outside.

Figure 19:
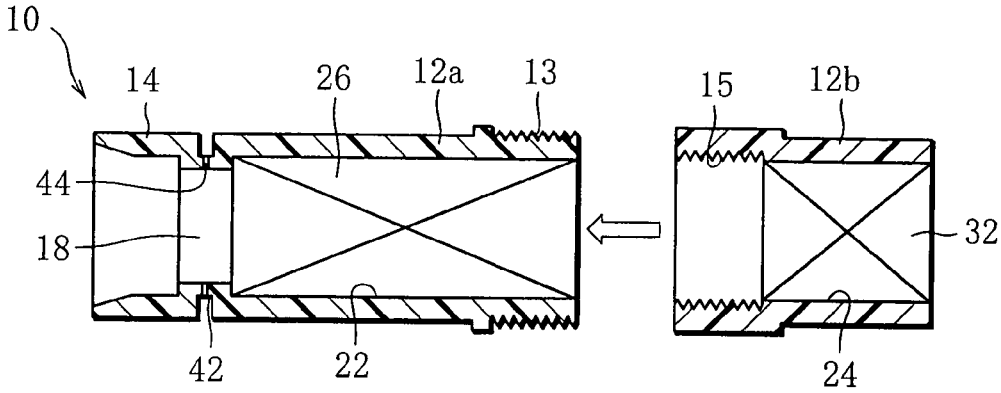
FIG. 19 is an exploded sectional view showing a filter holder according to an eighth embodiment of the present invention.

FIG. 19 shows a filter holder of an eighth embodiment.

The filter holder 10 of the eighth embodiment includes a split-type tubular body as with the filter holder of the seventh embodiment. In this case, a main portion 12*a* of the tubular body has a male screw 13 in an outer circumferential surface of a downstream end thereof. A secondary portion 12*b* of the tubular body is provided in an inner circumferential surface of an upstream end thereof with a female screw 15 that is threadably mounted on the male screw 13. Therefore, the main portion 12*a* and the secondary portion 12*b* are detachably coupled to each other by screwing the male screw 13 in the female screw of the secondary portion 12*b*.

According to the seventh and eighth embodiments, it is preferable that the secondary portion 12*b* function as a mouthpiece at the same time. It is further preferable that the secondary portion 12*b* contain the flavor generation element 32 and be packed in the form of the blister pack (see FIG. 2) or the airtight container (see FIG. 3).

Figure 20:
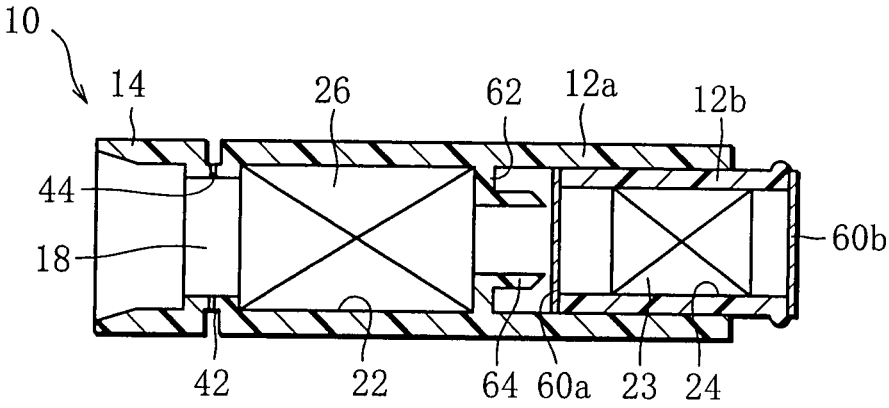
FIG. 20 is a sectional view showing a filter holder according to a ninth embodiment of the present invention before being used.
Figure 21:
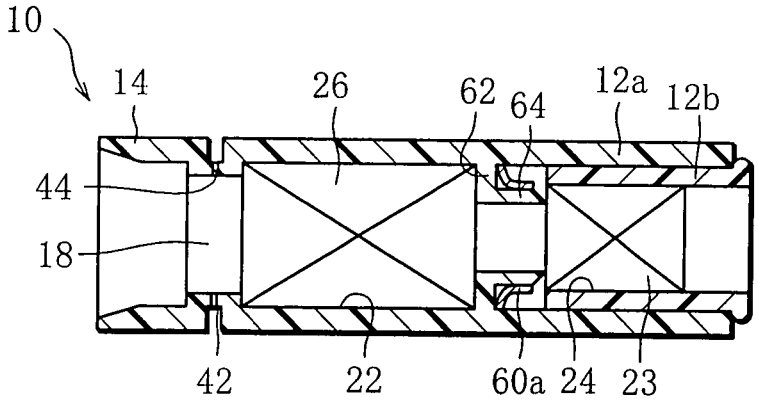
FIG. 21 is a sectional view showing the filter holder of FIG. 20 in an in-use state.

FIGS. 20 and 21 show a filter holder 10, or smoking pipe, of a ninth embodiment.

The smoking pipe of the ninth embodiment includes a split-type filter holder 10 like the filter holders of the seventh and eighth embodiments, that is, a tubular body. The tubular body has a main portion 12*a* and a secondary portion 12*b* that functions as a mouthpiece. The secondary portion 12*b* is detachably inserted into a downstream end of the main portion 12*a* beforehand, and is also slidable with respect to the main portion 12*a* in an axial direction of the main portion 12*a*. In this case, it is preferable that a flavor generation element 32 is previously contained in the secondary portion 12*b*, and that both ends of the secondary portion 12*b* are blocked by seals 60*a* and 60*b* such as aluminum films. The seals 60 prevent flavor components that have been volatized from the flavor generation element 32 from being released from the secondary portion 12*b*. This eliminates the need of the packing in the form of the blister pack or the airtight container in the secondary portion 12*b*.

In the main portion 12, there is formed a partition wall 62. The partition wall 62 is disposed in between a filter-containing chamber 22 of the main portion 12 and the secondary portion 12*b*. A hollow breaking needle 64 is integrally formed in the center of the partition wall 62. The breaking needle 64 is arranged concentrically in relation to the main portion 12*a* and is protruding toward the secondary portion 12*b*, to thereby communicate the filter-containing chamber 22 with a containing chamber of the secondary portion 12*b*. The breaking needle 64 has an external diameter that is slightly smaller than an internal diameter of the secondary portion 12*b* (external diameter of the flavor generation element 32), an internal diameter providing thickness that is approximately equal to thickness of the main portion 12, and a pointed end tapering toward the secondary portion 12*b*.

Before the smoking pipe of the ninth embodiment is used, the secondary portion 12*b* is in a state shown in FIG. 20. From this state, before smoking, the seal 60*b* located in an outer end of the secondary portion 12*b* is first peeled off. The secondary portion 12*b* is subsequently pushed into the main portion 12*a*. Accordingly, as illustrated in FIG. 21, the seal 60*a* located in the inner end of the secondary portion 12*b* is smashed by the pointed end of the breaking needle 64. As a result, the pointed end of the breaking needle 64 enters the secondary portion 12*b*. At this time, the charcoal filter 26 and the flavor generation element 32 are communicated with each other through the breaking needle 64.

Consequently, when a cigarette is smoked using the smoking pipe in a state shown in FIG. 21, the mainstream smoke that has passed through the charcoal filter 26 flows through the flavor generation element 32, and the flavor components that have been volatized from the flavor generation element 32 are added to the mainstream smoke.

Since the breaking needle 64 enters the secondary portion 12*b* as described above, it is required to secure a space for allowing the enter of the breaking needle 64 in between the seal 60 on the inner end side of the secondary portion 12*b* and the flavor generation element 32. As is apparent from FIGS. 20 and 21, however, the space may be secured in each side of the flavor generation element 32.

Figure 22:
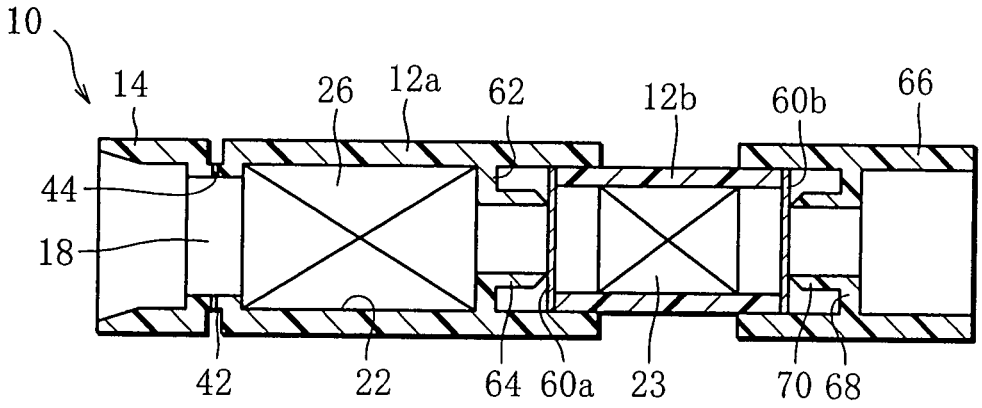
FIG. 22 is a sectional view showing a filter holder according to a tenth embodiment of the present invention.

FIG. 22 shows a filter holder 10, or smoking pipe, of a tenth embodiment.

The smoking pipe of the tenth embodiment includes the split-type filter holder 10 similar to the ninth embodiment and a mouthpiece 66. The mouthpiece 66 is fitted to an outer end of a secondary portion 12*b* of the filter holder 10 and is slidable with respect to the secondary portion 12*b* in an axial direction of the filter holder 10. The mouthpiece 66 is provided in the inside thereof with a partition wall 68 and a breaking needle 70 similar to a partition wall 62 and a breaking needle 64 of a main portion 12*a*. The breaking needle 70 is protruding toward the secondary portion 12*b*.

According to the tenth embodiment, before the smoking pipe is used for smoking, the main portion 12*a* and the mouthpiece 66 are displaced in such a direction as to approach each other. In this process, seals 60*a* and 60*b* located at both sides of the secondary portion 12*b* are smashed by the breaking needles 64 and 70. In this case, it is not necessary to peel off the seal 60*b*.

Figure 23:
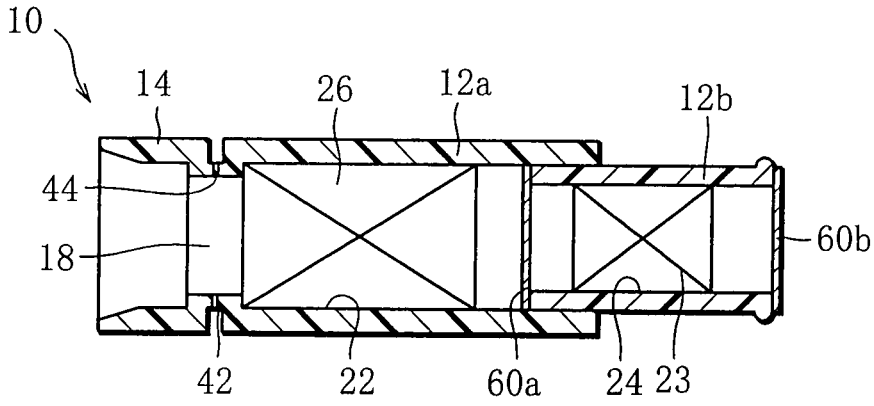
FIG. 23 is a sectional view showing a filter holder according to an eleventh embodiment of the present invention.

FIG. 23 shows a filter holder 10, or smoking pipe, of an eleventh embodiment.

The smoking pipe of the eleventh embodiment can be obtained by removing the partition wall 62 and the breaking needle 64 from the smoking pipe of the ninth embodiment (FIGS. 20 and 21). In this case, before the smoking pipe of FIG. 23 is used for smoking, seals 60*a* and 60*b* of a secondary portion 12*b* are peeled off.

Figure 24:
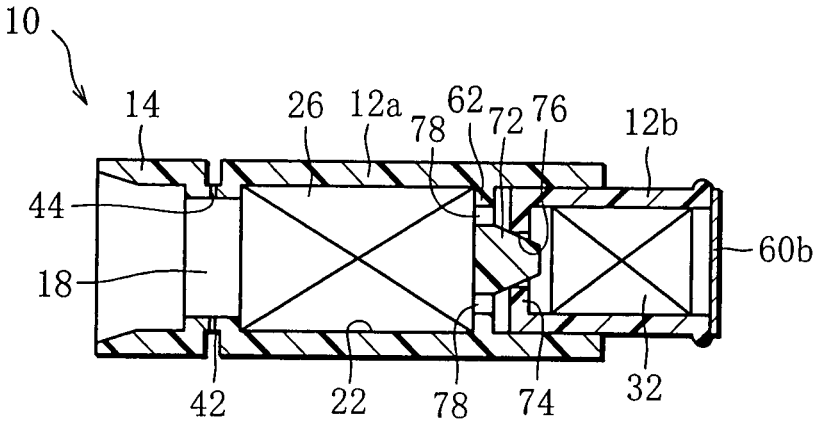
FIG. 24 is a sectional view showing a filter holder according to a twelfth embodiment of the present invention before being used.
Figure 25:
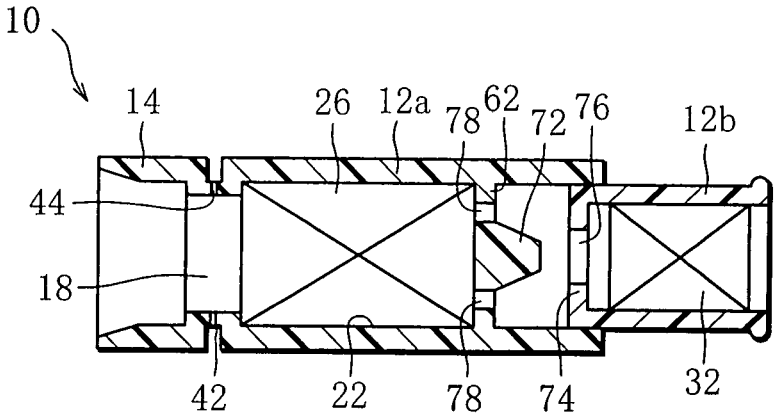
FIG. 25 is a sectional view showing the filter holder of FIG. 24 in an in-use state.

FIGS. 24 and 25 show a filter holder 10, or smoking pipe, of a twelfth embodiment.

The smoking pipe of the twelfth embodiment differs from the smoking pipe of the ninth embodiment (FIGS. 20 and 21) in the following points.

The smoking pipe of the eleventh embodiment includes a plug 72 instead of the breaking needle 64. The plug 72 is protruding from the partition wall 62 toward the secondary portion 12*b* and has a tapered tip end. A plurality of communication holes 78 are formed in the partition wall 62. The communication holes 78 are formed outside the plug 72 at intervals in a circumferential direction of the plug 72. The secondary portion 12*b* has an inner end wall 74 as a substitute for the seal 60*a*, and a communication hole 76 formed in the center of the inner end wall 74. As illustrated in FIG. 24, the plug 72 is inserted into the communication hole 76 of the secondary portion 12*b*, to thereby block the communication hole 76.

The smoking pipe of the twelfth embodiment is in a state shown in FIG. 24 before being used. When the secondary portion 12*b* is pulled out of a main portion 12*a* as illustrated in FIG. 25 before the smoking pipe is used for smoking, the plug 76 is drawn out of the communication hole 76. Therefore, the flavor generation element 32 in the secondary portion 12*b* is communicated with a charcoal filter 26 placed in the main portion 12*a* through the communication hole 76, space between the partition wall 62 and the secondary portion 12*b*, and the communication holes 78.

For this reason, the mainstream smoke that has passed through the charcoal filter 26 flows into the flavor generation element 32 in the secondary portion 12*b*. At this time, the flavor components are added to the mainstream smoke.

Figure 26:
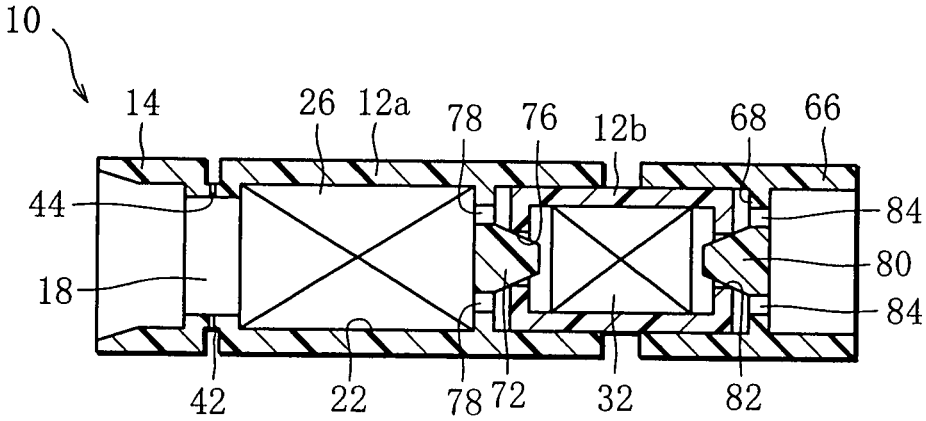
FIG. 26 is a sectional view showing a filter holder according to a thirteenth embodiment of the present invention.

FIG. 26 shows a filter holder 10, or smoking pipe, of a thirteenth embodiment.

The smoking pipe of the thirteenth embodiment includes the filter holder 10 similar to the filter holder shown in FIG. 24 and a mouthpiece 66 similar to the mouthpiece 66 shown in FIG. 22. The mouthpiece 66 has a partition wall 68, a plug 80 and communication holes 84 similar to the partition wall 62, the plug 72 and the communication holes 78, respectively, instead of the breaking needle 70. The plug 80 is protruding toward the secondary portion 12*b*. The secondary portion 12*b* has an outer end wall instead of the seal 60*b*, and a communication hole 82 formed in the outer end wall. The plug 80 is inserted into the communication hole 82, to thereby block the communication hole 82.

In the case of the smoking pipe of the thirteenth embodiment, before being used for smoking, the secondary portion 12*b* is pulled out of a main portion 12*a*, and the mouthpiece 66 is drawn out of the secondary portion 12*b*. As a result, the plugs 72 and 80 are pulled out of the communication holes 76 and 82, respectively. This forms a channel that communicates with a charcoal filter 26 and a flavor generation element 32, respectively.

Figure 27:
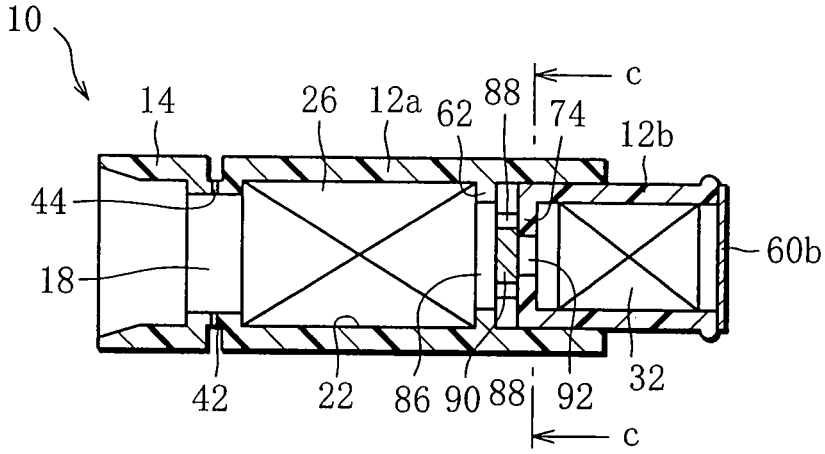
FIG. 27 is a sectional view showing a filter holder according to a fourteenth embodiment of the present invention before being used.
Figure 28:
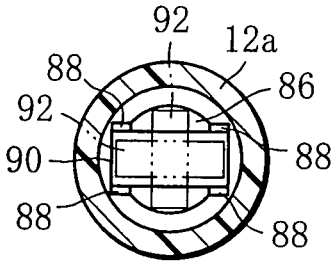
FIG. 28 is a cross-sectional view showing the filter holder of FIG. 27.
Figure 29:
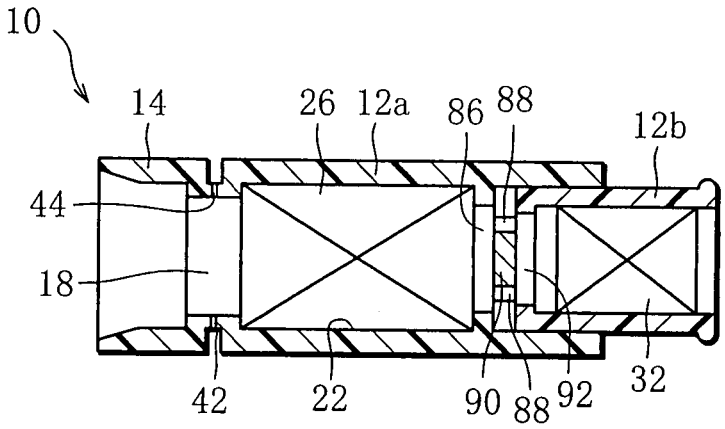
FIG. 29 is a sectional view showing the filter holder of FIG. 27 in an in-use state.

FIGS. 27 to 29 show a filter holder 10, or smoking pipe, of a fourteenth embodiment.

The smoking pipe of the fourteenth embodiment differs from that of the twelfth embodiment (FIG. 24) in the following points.

According to the fourteenth embodiment, the secondary portions 12*a* and 12*b* are rotatably inserted into a main portion 12*a*. A partition wall 62 of the main portion 12*a* has a large center hole 86 instead of the plug 72 and the communication holes 78. Four claws 88 are formed in an inner circumferential edge of the center hole 86. The claws 88 are arranged in four corners of a rectangle as is apparent from FIG. 28 and are protruding toward the secondary portion 12*b*. A rectangular cover plate 90 is set inside the claws 88. The cover plate 90 extends in a direction across the center hole 86.

A rectangular aperture 92 is formed in an inner end of the secondary portion 12*b*. The aperture 92 is smaller than the cover plate 90. As illustrated in FIG. 27, when the smoking pipe is in a state before being used, the hole 92 is in the same position as the cover plate 90 (horizontal position shown by a chain double-dashed line in FIG. 28) and is closed by the cover plate 90.

Before being used for smoking, a seal 60*b* located in an outer end of the secondary portion 12 is peeled off, and the secondary portion 12*b* is rotated with respect to the main portion 12*a* by 90 degrees around an axis of the secondary portion 12*b*. At this time, hole 92 is changed into a position where it is orthogonal to the cover plate 90 (vertical position shown by a solid line in FIG. 28). As illustrated in FIG. 29, both ends of the hole 92 come off from the cover plate 90, so that the hole 92 communicates with the center hole 86. As a result, there is formed a channel that communicates with a charcoal filter 26 and a flavor generation element 32, respectively.

Figure 30:
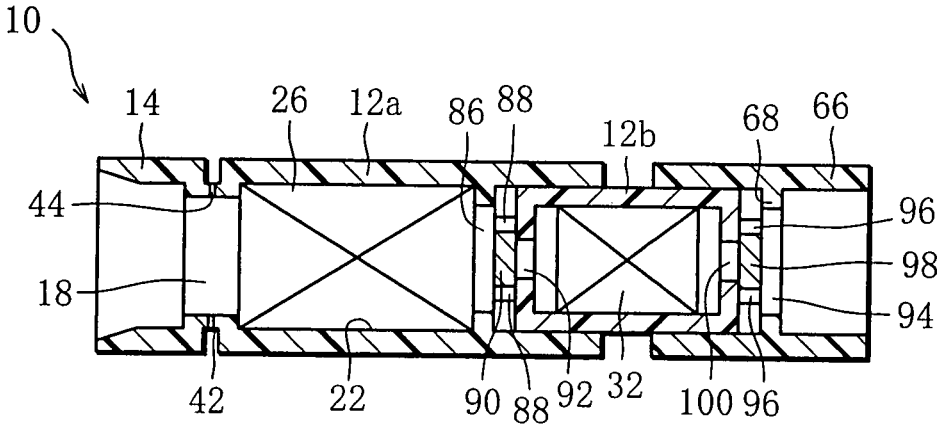
FIG. 30 is a sectional view showing a filter holder according to a fifteenth embodiment of the present invention.

FIG. 30 shows a filter holder 10, or smoking pipe, of a fifteenth embodiment.

The smoking pipe of the fifteenth embodiment includes the filter holder 10 of the fourteenth embodiment and a mouthpiece 66 corresponding to the mouthpiece shown in FIG. 26. The mouthpiece 66 is rotatably fitted to a secondary portion 12*b* and is provided in a partition wall 68 with a center hole 94 and claws 96 corresponding to the center hole 86 and the claws 88. A rectangular cover plate 98 is held by the claws 96. The secondary portion 12*b* has an outer end wall and a rectangular aperture 100 formed in the outer end wall.

According to the smoking pipe of the fifteenth embodiment, when the secondary portion 12*b* and the mouthpiece 66 are rotated, there is formed a channel communicating with a charcoal filter 26 and a flavor generation element 32, respectively.

Figure 31:
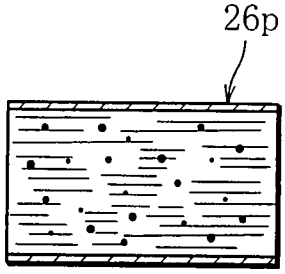
FIG. 31 is a sectional view showing a paper filter.

FIG. 31 shows a paper filter 26*p* that can be used instead of the charcoal filter 26. The paper filter 26*p* includes filter material obtained by forming thin paper into a rod, instead of a bundle of cellulose acetate fibers, and active-charcoal particles distributed in the filter material.

The charcoal filter 26 and the flavor generation element 32 coexist in the inside of each of the smoking pipes shown in FIGS. 20 to 30. However, before the smoking pipe is used, the flavor generation element 32 located in the secondary portion 12*b* is protected by the seals 60*a* and 60*b*, the plugs 72 and 80 or the cover plates 90 and 98. Therefore, the flavor components volatized from the flavor generation element 32 are not released outside of the secondary portion 12*b*.

The filter holders 10, or smoking pipes, shown in FIGS. 18 to 30 each include the annular groove 42 and the vent holes 44. However, the annular groove 42 and the vent holes 44 may be omitted.

The invention claimed is:

1. A smoking pipe comprising:

a tubular body including a holder portion formed in one end portion thereof and capable of holding smokable material, an upstream chamber defined in said tubular body adjacently to the holder portion, and a downstream chamber secured downstream of the upstream chamber;

an absorption filter contained in the upstream chamber, for filtrating mainstream smoke of the smokable material;

a flavor generation element contained in the downstream chamber, for generating flavor to be added to the mainstream smoke, said flavor generation element including filter material, flavoring added to the filter material, and wrapping paper wrapping the filter material into a cylindrical shape; and a separator containing the flavor generation element and forming the other end of said tubular body, for keeping the flavor generation element airtightly separated from the filter until the smoking pipe is used, said separator allowing an air communication path to be formed from the filter to the other end of said tubular body by way of the flavor generation element to produce the mainstream smoke passing through the flavor generation element toward the other end of said tubular body, the air communication path having an upstream opening located between the filter and the flavor generation element and a downstream opening located at the other end of said tubular body, when the smoking pipe is used.

2. The smoking pipe according to claim 1, further comprising:

a mixing device for mixing a gaseous fluid to be used for processing the mainstream smoke with the mainstream smoke at least in either one of an upstream area including an upstream end of the upstream chamber and the downstream chamber as viewed in a flowing direction of the mainstream smoke.

3. The smoking pipe according to claim 2, wherein:

said mixing device includes:

a recessed area formed in an outer circumferential surface of said tubular body, the recessed are being not blocked by a smoker's fingers when said tubular body is held by the fingers; and a vent hole having one end opening into the recessed area and the other end opening into an inner circumferential surface of said tubular body in the upstream area.

4. The smoking pipe according to claim 3, wherein:

the recessed area is an annular groove formed in the outer circumferential surface of said tubular body; and the vent hole is formed in a bottom of the annular groove.

5. The smoking pipe according to claim 4, wherein:

said mixing device further includes a dilution chamber located in between the holder portion and the chamber in said tubular body, the dilution chamber being connected to the vent hole.

6. The smoking pipe according to claim 4, wherein:

said mixing device further includes an adjust ring for adjusting an opening of the vent hole, the adjust ring being disposed within the annular groove and movable in either one of a circumferential direction or axial direction of said tubular body.

7. The smoking pipe according to claim 3, wherein:

the holder portion is formed as a cylindrical socket for receiving an end portion of the rod-shaped smoking article.

8. The smoking pipe according to claim 1, wherein:

said tubular body includes a main portion having the holder portion and the upstream chamber and a secondary portion having the downstream chamber forming part of the separator, and the main and secondary portions are detachably coupled to each other.

9. The smoking pipe according to claim 1, wherein:

the filter is a charcoal filter, and the flavoring is menthol.

10. The smoking pipe according to claim 8, wherein said separator includes:

a separation wall provided at one end of the secondary portion, the separation wall airtightly separating the filter and the flavor generation element, and an opener for opening the separation wall by relatively moving the secondary portion in an axial direction or a circumferential direction of said tubular body with respect to the main portion.

11. The smoking pipe according to claim 10, wherein the other end of the secondary portion forms the other end of said tubular body.

12. The smoking pipe according to claim 11, wherein said separator further includes a seal member detachably provided at the other end of the secondary portion, the seal member closing the other end of the secondary portion.

13. The smoking pipe according to claim 10, wherein said separator further includes:

a second separator wall provided at the other end of the secondary portion, the second separation wall airtightly sealing the secondary portion, a third portion jointed to the secondary portion and forming the other end of said tubular body, and a second opener for opening the second separation wall by relatively moving the third portion in an axial direction or a circumferential direction of said tubular body with respect to the secondary portion.

14. The smoking pipe according to claim 9, wherein the charcoal filter also includes the filter material, active-charcoal particles distributed in the filter material, and the wrapping paper wrapping the filter material into the cylindrical shape to form a main filter portion.

15. The smoking pipe according to claim 14, wherein the charcoal filter further includes:

end filter portions located at respective ends of the main filter portion, and forming paper wrapping the main filter portion and the end filter portions in order to join the main filter portion and the end filter portions together.

* * * * *